US007474321B2

(12) United States Patent
Wiens

(10) Patent No.: US 7,474,321 B2
(45) Date of Patent: Jan. 6, 2009

(54) THERMAL RECORDING METHOD AND SYSTEM EMPLOYING EDGE PRINTING

(75) Inventor: Curt A. Wiens, Oakdale, MN (US)

(73) Assignee: Carestream Health, Inc., Rochester, NY (US)

( * ) Notice: Subject to any disclaimer, the term of this patent is extended or adjusted under 35 U.S.C. 154(b) by 490 days.

(21) Appl. No.: 11/196,822

(22) Filed: Aug. 3, 2005

(65) Prior Publication Data

US 2007/0030330 A1 Feb. 8, 2007

(51) Int. Cl.
*B41J 2/325* (2006.01)

(52) U.S. Cl. ..... 347/175

(58) Field of Classification Search ..... None
See application file for complete search history.

(56) References Cited

U.S. PATENT DOCUMENTS 4,738,553 A 4/1988 Uemura et al.
4,960,336 A 10/1990 Brooks et al.
5,557,303 A 9/1996 Agano et al.
5,661,512 A * 8/1997 Fukuda et al. ..... 347/175
5,798,783 A 8/1998 Maslanka et al.
6,305,856 B1 10/2001 Miyazaki
6,496,211 B2 12/2002 Katsuma
6,733,109 B1 5/2004 Lorenz et al.
7,319,472 B2 * 1/2008 Inoue ..... 347/175
7,321,375 B2 * 1/2008 Otaka et al. ..... 347/171

* cited by examiner

*Primary Examiner*—K. Feggins

(57) ABSTRACT

An imaging device (30) comprising an array of individually controllable thermal recording elements (36) and a controller (34). Controller (34) is configured to receive an input signal (42) and, based on input signal (42), is configured to select, activate, and drive a plurality of thermal elements (60*a*, 60*b*) from the array of thermal elements (36) which correspond to areas (62*a*, 62*b*) of an imaging media (38) which are outside an imaging area (52) of imaging media (38).

22 Claims, 4 Drawing Sheets

THERMAL RECORDING METHOD AND SYSTEM EMPLOYING EDGE PRINTING

FIELD OF THE INVENTION

The present invention relates generally to an apparatus and method for thermally recording an image on a recording media, and more specifically to an apparatus and method for thermally printing along edges of a recording media.

BACKGROUND OF THE INVENTION

Thermal imaging, or thermography, is a recording process wherein images are generated by the use of image-wise modulated thermal energy. There are two commonly known methods for thermal imaging. The first is generally referred to as thermal dye transfer printing, and the second is referred to as direct thermal printing. Direct thermal printing involves heating a thermosensitive media to produce a desired image on the thermosensitive media. Thermosensitive media typically comprises a base material, such as polyester, coated with a thermosensitive layer generally containing an organic silver salt. When heated, the organic silver salt is reduced to metallic silver, thereby producing a density at any given location that is a function of the amount of thermal energy provided to the media at the given location.

Application of heat to the thermosensitive media is generally accomplished through use of a thermal recording head or printhead. Thermal printheads typically comprise a number of microscopic heating elements, generally resistors, which are usually spaced in a line-wise fashion across the printhead such that each resistor provides one pixel of a line of pixels produced on the thermosensitive media by the thermal printhead. When printing a desired image, electrical pulses representative of densities corresponding to the desired image are provided to and energize the resistors. Each resistor converts the pulses to thermal energy which is transferred to the thermosensitive media to produce the corresponding pixel at the corresponding density. The image is printed one line of pixels at a time by the thermal printhead as the thermosensitive media is incrementally moved past the thermal printhead by a media transport system.

Most types of thermosensitive media also include a protective layer over the thermosensitive layer. In addition to reducing the occurrence of scratches in the thermosensitive layer, the protective layer includes heat-activated lubricants which are activated during the printing process. Additionally, the protective layer, as well as the thermosensitive layer, "softens" when heated during the printing process. The lubricants and softening of the media reduce the friction between the printhead and media during the printing process. This helps the media to move more easily past the printhead and reduces the occurrence of image artifacts during the printing process. Although thermal printheads generally include a protective coating over the resistors, such as silicon carbide (SiC), for example, reducing friction between the media and the printhead reduces wear on the protective coating and can extend the life of the printhead.

During the printing process, energizing resistors corresponding to pixels beyond the edges of the thermosensitive media can cause such resistors to overheat since the media is not present to absorb and dissipate the generated thermal energy. Such overheating can cause gradual changes in the ohmic value of the resisitor, resulting in a gradual deterioration of image quality. Such overheating may eventually result in failure of the resistors, often referred to as pixel failure. Therefore, to prevent such pre-mature pixel failure and to compensate for slight variations in width and positioning of the media as it moves past the thermal printhead, an edge or border around the perimeter of the media is generally left un-printed.

However, since these border areas of the thermosensitive media are not heated, lubricants are not activated and the media does not soften in the border areas. As a result, there is typically greater friction between the printhead and the media in the border areas than in the printed or "imaged" area. This is especially true when the protective layer includes purposely "raised" particles designed to remove deposits from the printhead. This difference in friction can lead to uneven wearing of the protective coating over the resistors of the printhead and, consequently, to uneven heat transfer characteristics across the width of the printhead. Uneven heat transfer, in-turn, often translates to uneven densities in a printed image.

Uneven wear across a printhead can be especially troublesome when the printhead is used to print images on multiple widths of thermosensitive media. While a narrow width media, in general, will cause a difference in wear across the width a printhead, the wear will be greatest on those areas of the printhead corresponding to the un-printed borders. When printing an image on a media having a greater width, those areas of the printhead may correspond to the imaged area of the media and may produce uneven densities relative to adjacent areas of the printhead as a result of the even wear.

It is evident that there is a need for improving thermal imaging systems, particularly those used to print images on multiple widths of thermosensitive imaging media, to reduce problems associated with un-printed border areas.

SUMMARY OF THE INVENTION

In one embodiment, the present invention provides an imaging device comprising an array of individually controllable thermal recording elements and a controller. The controller is configured to receive an input signal and, based on the input signal, configured to select, activate, and drive a plurality of thermal elements from the array of thermal elements which correspond to areas of an imaging media which are outside an imaging area of the imaging media.

In one embodiment, the input signal is representative of characteristics of the imaging media. In one embodiment, the input signal is representative of a width of the imaging media.

In one embodiment, the selected plurality of thermal recording elements correspond to border areas of the imaging media which are immediately adjacent to edges of the imaging media. In one embodiment, the controller drives each thermal recording element of the selected plurality of thermal recording elements so as to provide an amount of thermal energy substantially equal to a desired border energy level.

In one embodiment, the controller drives the selected plurality of thermal recording elements with image signals comprising non-image data representative of a desired border density value. In one embodiment, the controller drives thermal recording elements of the array corresponding to the imaging area of the imaging media with image signals comprising image data representative of density values of a desired image.

In one embodiment, the present invention provides an imaging device for thermally recording images on a media having an image area. The imaging device includes a plurality of individually controllable thermal elements, each thermal element configured to produce a level of thermal energy based on a binary signal so as to produce at a corresponding location on the media a density level that is a function of the level of thermal energy. A controller is configured to receive a media signal representative of characteristics of the media and, based on the media signal, configured to select from the plurality of thermal elements a group of thermal elements corresponding to locations outside the image area, and to provide to each thermal element of the selected group a binary signal that causes each thermal element of the selected group to provide a level of thermal energy substantially equal to a desired border energy level.

In one embodiment, the desired border energy level is within a border energy level range. In one embodiment, wherein the media softens when a threshold level of thermal energy is transferred to the media, a lower level of the border energy level range is at least equal to the threshold level. In one embodiment, wherein thermal elements corresponding to locations beyond the border area of the media are thermally damaged when providing a level of thermal energy above a critical level, an upper level of the border energy level range is less than the critical level.

By causing thermal elements corresponding to border areas of the media to provide a level of thermal energy at a desired border energy level, the imaging device "prints" the border areas of the media. By printing the border areas using a thermal energy level that is adequate to soften the media in the border areas, but less than a level that will cause appreciable thermal damage to those thermal elements which are not proximate to the media, the thermal printer reduces wear on areas of the printhead corresponding to the border areas of the media without substantially increasing the occurrence of pre-mature pixel failure.

As a result of the reduced wear, heat transfer characteristics will be more even across the width of the printhead during its lifetime, thereby increasing image quality by reducing the likelihood of uneven image densities when the printhead is employed to print images on varying widths of media.

DETAILED DESCRIPTION OF THE INVENTION

Figure 1:
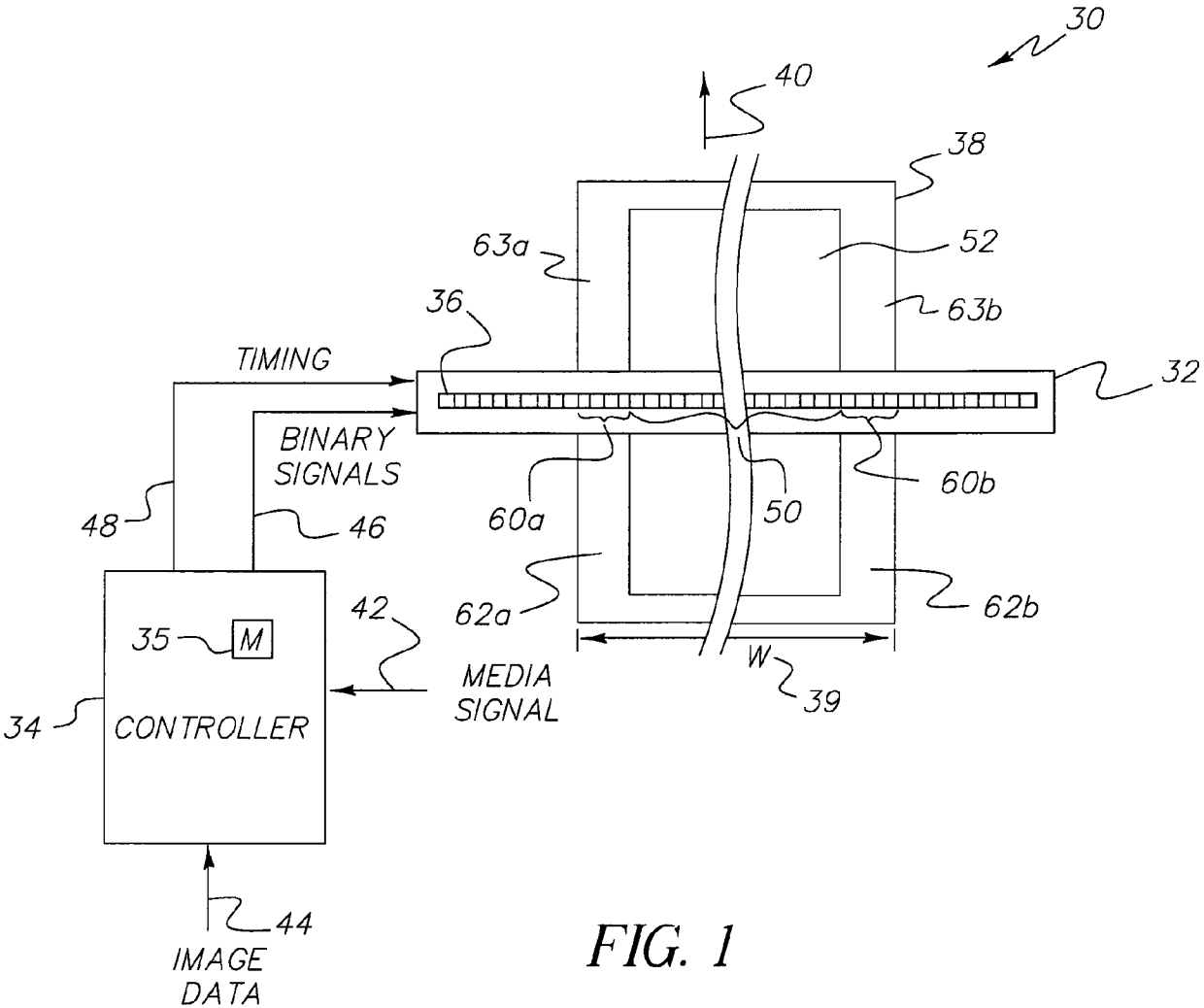
FIG. 1 is a block diagram illustrating generally one exemplary embodiment of a direct thermal printer according to the present invention.

FIG. 1 is a block diagram illustrating generally one embodiment of a direct thermal printer 30 configured to provide edge printing of borders (i.e. edges) of a recording media to reduce printhead wear in accordance with embodiments of the present invention. Thermal printer 30 includes a thermal printhead 32 and a controller 34, with printhead 32 further including a plurality of individually energizeable thermal elements 36 spaced in a line-wise fashion across printhead 32. Thermal printer 30 further includes a media transport system (not shown) which is configured to receive and transport a recording media 38 past printhead 32, such as in a direction indicated by directional arrow 40. In one embodiment, thermal printer 30 is configured to print desired images on multiple widths of thermosensitive media 38.

In one example, recording media 38 comprises a thermosensitive media having a base material, such as polyester, coated with a thermosensitive layer containing an organic silver salt. As thermosensitive media 38 is moved past thermal printhead 32, thermal elements 36 heat proximate areas of thermosensitive media 36, which reduces the organic silver salt to metallic silver and produces a density in the proximate areas that is a function of the amount of thermal energy provided by the corresponding thermal element 36. Each of the proximate areas heated by thermal elements 36 comprises a pixel of a printed image, with each thermal element 36 providing one pixel of a line of pixels provided by thermal printhead 32. Thermal printhead 32 prints one line of pixels, or scan-line, at a time as imaging media 38 is moved past, such that a printed image comprises a plurality of scan lines.

Controller 34 receives a media signal 42 indicative of characteristics of imaging media 38, such as a width (W) 39, of thermosensitive media 38, and digital image data 44 which is representative of the density values of each pixel of a desired image which is to be printed on thermosensitive media 38. Controller 34 converts digital image data 44 into a plurality of image signals 46, one for each pixel of the printed image. In one embodiment, as illustrated, controller 34 converts digital image data 44 into a plurality of binary signals, one for each pixel of the printed image, and each comprising a sequence of 1-bit data values representative of the density value of the corresponding pixel. Controller 34 provides binary signals 46, along with an enable signal 48, to thermal printhead 32.

Printhead 32 employs enable signal 48 and binary signals 46 to generate electrical pulses representative of the density values to corresponding thermal elements 36 of a group 50 of thermal elements 36 which correspond to an image area 52 of thermosensitive media 38, as determined based on media signal 42. Each thermal element 36 of group 50 converts the corresponding electrical pulses to thermal energy which is transferred to thermosensitive media 38 and produces the corresponding density value in the corresponding pixel. The shaded portion of imaging area 52 is intended to illustrate the printed pixels of the desired image.

Based on media signal 42, controller 34 is further configured to select a group 60 of thermal elements 36, illustrated as groups 60*a* and 60*a*, of thermal printhead 32 which correspond respectively to a first border area 62*a* and a second border area 62*b* of photosensitive media 38. Independent from image data 44, controller 34 is configured to provide a binary signal 46 to each thermal element 36 of groups 60*a* and 60*b*, that causes each thermal element 36 of groups 60*a* and 60*b* to provide a level of thermal energy substantially equal to a desired border energy level.

In one embodiment, the binary signals providing the desired border energy level comprise predetermined sequences of 1-bit values stored in a memory 35. In one embodiment, controller 34 generates the binary signals providing the desired border energy level and adjusts the sequence of 1-bit values based on factors such as, for example, a temperature of thermal printhead 32, dimensions of border areas 62*a*, 62*b*, and dimensions of thermosensitive media 38.

In one embodiment, as illustrated, the selected group 60 of thermal elements 36 comprises only those thermal elements 36 that correspond to border areas 62*a* and 62*b* of thermosensitive media 36. In one embodiment, in addition to thermal elements 36 that correspond to border areas 62*a* and 62*b*, a selected group 60 includes a plurality of thermal elements 36 beyond border areas 62*a* and 62*b* to compensate for variations in width 39 of photosensitive media 38. In one embodiment, selected group 60 comprises all thermal elements 36 of thermal printhead 32 that are beyond imaging area 52. In one embodiment, controller 34 selects the group of thermal elements 60*a*, 60*b* from a look-up table stored in memory 35 based on media signal 42.

Lubricants within the protective layer are activated and thermosensitive media, such as media 38, softens when heated during the printing process. Providing high amounts of energy to thermal elements, such as thermal elements 36, which are beyond the edges of the thermosensitive media, such as thermosensitive media 38, can cause overheating and pre-mature failure of the thermal elements. Thus, in one embodiment, the desired border energy level comprises an energy level that is adequate to activate the lubricants and to soften the thermosensitive media, but less than an amount of energy that will appreciably shorten the expected operational life of thermal elements not positioned above the thermosensitive media during the printing process.

Thermosensitive media, such as thermosensitive media 38, has an inherent or "base" density prior to printing of an image by thermal printer 30. Application of thermal energy to thermosensitive media 38 by thermal elements 36 reduces organic silver salt in the thermosensitive layer to metallic silver and produces a density that is a function of the amount of thermal energy transferred to thermosensitive media 38. A certain minimum amount of thermal energy is required to produce a minimum change in density which is generally detectable over the base density. This minimum detectable density is generally referred to $D_{MIN}$. Similarly, a certain maximum amount of thermal energy will reduce substantially all of the silver salt to metallic salt and produce a maximum density. Thermal energy in excess of this maximum amount can damage the thermosensitive media. As such, when printing, the amount of thermal energy provided to thermosensitive media 38 is generally limited to a maximum "printing" thermal energy that produces a desired maximum density change over the base density. This maximum printing density is generally referred to as $D_{MAX}$.

Figure 2:
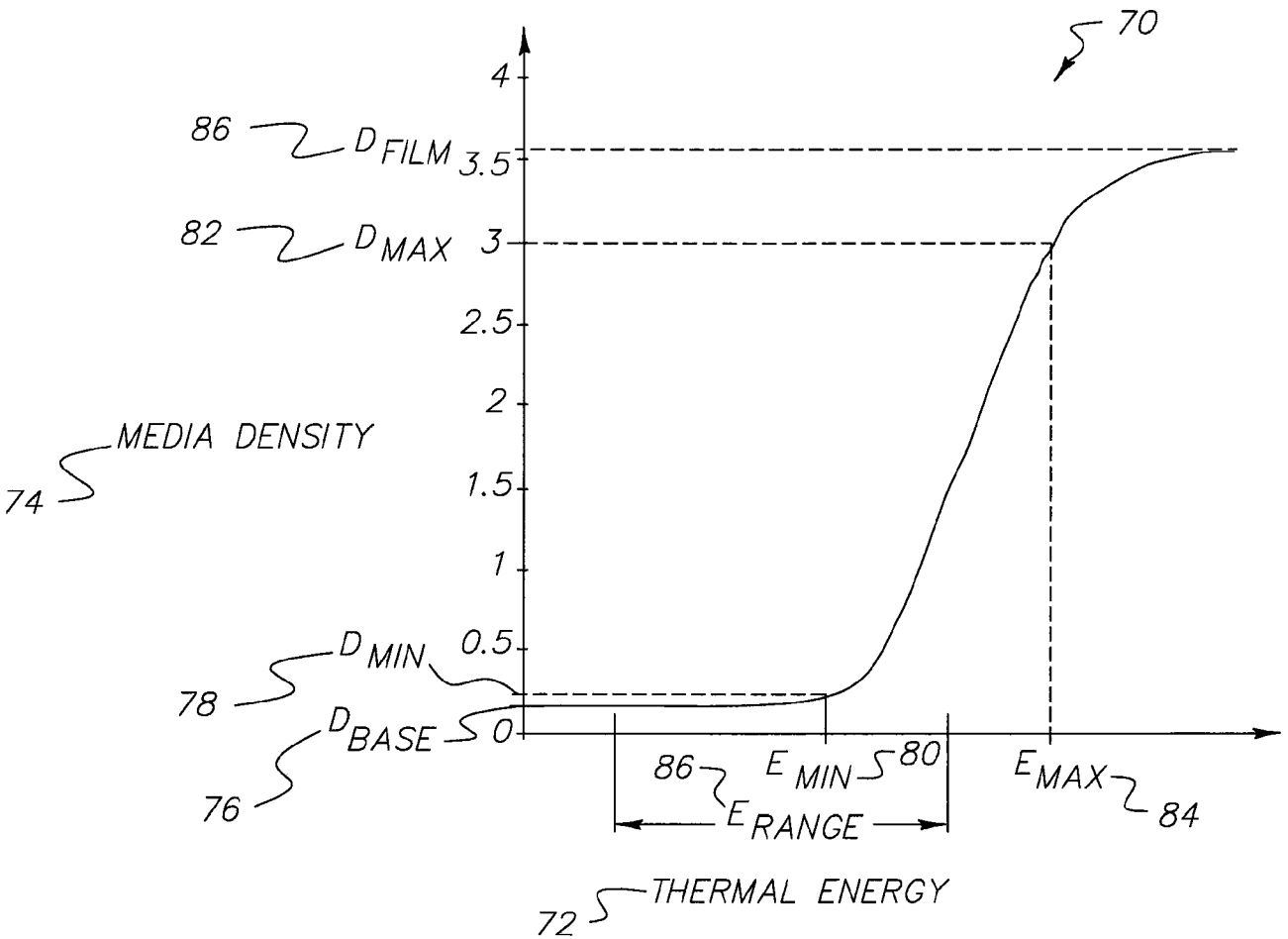
FIG. 2 is a graph illustrating an example of the density of thermosensitive media versus applied thermal energy.

FIG. 2 is graph 70 illustrating an example of the density of thermosensitive media 38 versus the amount of thermal energy applied by thermal elements 36. Density and thermal energy levels are respectively illustrated along the y-axis and x-axis, as illustrated at 72 and 74. The base density ($D_{BASE}$) of thermosensitive media 38 is indicated at 76. The minimum density ($D_{MIN}$) generally detectable over $D_{BASE}$ 76 is indicated at 78, with the thermal energy required to produce $D_{MIN}$ 78 indicated as $E_{MIN}$ at 80. The maximum printing density ($D_{MAX}$) is indicated at 82, with the maximum printing thermal energy required to produce $D_{MAX}$ 82 indicated as $E_{MAX}$ at 84. The maximum density of capable of being produced with thermosensitive media 36 is illustrated as $D_{FILM}$ at 86. It should be noted that $D_{MAX}$ may vary based on the type of thermosensitive imaging media or on the application. For example, the $D_{MAX}$ for direct thermal film employed for medical imaging purposes may vary from 2.6 to 3.5 density units.

In one embodiment, with reference to the above description and FIG. 2, the desired border energy level comprises a range of thermal energy levels, as illustrated by $E_{RANGE}$ at 86 in FIG. 2. In one embodiment, the lower end of the range is substantially equal to twenty-percent of the maximum printing thermal energy $E_{MAX}$ 84 and the upper end of the range is substantially equal to seventy-percent of $E_{MAX}$ 84. With reference also to FIG. 1, providing thermal energy levels within this range via thermal elements 36 in groups 60*a* and 60*b* will soften thermosensitive media 38 and activate lubricants in border areas 62*a* and 62*b*, thereby reducing friction between border areas 62*a*, 62*b* of thermosensitive media 38 and thermal printhead 32. Furthermore, inadvertently providing thermal energy levels within this range to thermal elements 36 beyond the edges of thermosensitive media 38 due to slight variations in the width 39 and positioning of thermosensitive media 38 relative to thermal printhead 32, will not appreciably affect the resistance or reduce the expected life of such thermal elements 36.

By causing thermal elements corresponding to border areas of the thermosensitive media to provide a level of thermal energy at a desired border energy level, such as thermal elements 36 of groups 60*a*, 60*b* corresponding to border areas 62*a* , 62*b* of thermosensitive media 38, direct thermal printer 30 according to the present invention "prints" the border areas of thermosensitive media. By printing the border areas using a thermal energy level that is adequate to soften the thermosensitive media in the border areas, but less than a level that will cause appreciable thermal damage to those thermal elements which are not proximate to the thermosensitive media, thermal printer 30 reduces wear on areas of the printhead corresponding to the border areas of the thermosensitive media without substantially increasing the occurrence of premature pixel failure. As a result of the reduced wear, heat transfer characteristics will be more even across the width of the printhead during its lifetime, thereby increasing image quality by reducing the likelihood of uneven image densities when the printhead is employed to print images on varying widths of thermosensitive media.

In one experimental implementation, one embodiment of a thermal printhead configured to provide edge printing in accordance with the present invention was employed to print 5,000 sheets of imaging media. In one case, the thermal elements of a first section of the thermal printhead were driven to print at an energy level approximately equal to 40% of the maximum printing energy (see $E_{MAX}$ 84 in FIG. 2) and the thermal elements of a second section of the thermal printhead were not energized (i.e. 0% of $E_{MAX}$ energy). After printing the 5,000 sheets of imaging media, the wear on a protective coating of the printhead in an area corresponding to the 0% energy section was measured at 2.5 microns, while the wear in an area corresponding to the 40% energy section was measured to be only 1.0 microns. As such, in this scenario, providing 40% of the maximum printing energy to the thermal elements reduced printhead wear by 60% as compared to providing no energy to the thermal elements.

Although "printing" the border area using a desired border energy level above $E_{MIN}$ 80 (see FIG. 2), as described the experimental implementation above, may produce a perceptible change in the density level of the border areas of the thermosensitive media (such shaded areas 63*a*, 63*b* of border areas 62*a*, 62*b* of thermosensitive media 38 of FIG. 1), the change in density level will be minimal and uniform and, thus, will not detract from the printed image in the image area 52. As such, drawbacks associated with such density levels being perceptible are generally outweighed by the benefits gained from more even wear across the width of printhead 32. Furthermore, if a desired border energy below $E_{MIN}$ 80 is adequate to "soften" a given imaging media, the benefits of reduced friction between the thermal printhead and the imaging media can be achieved without producing a generally perceptible change in the density of the border areas.

Figure 3:
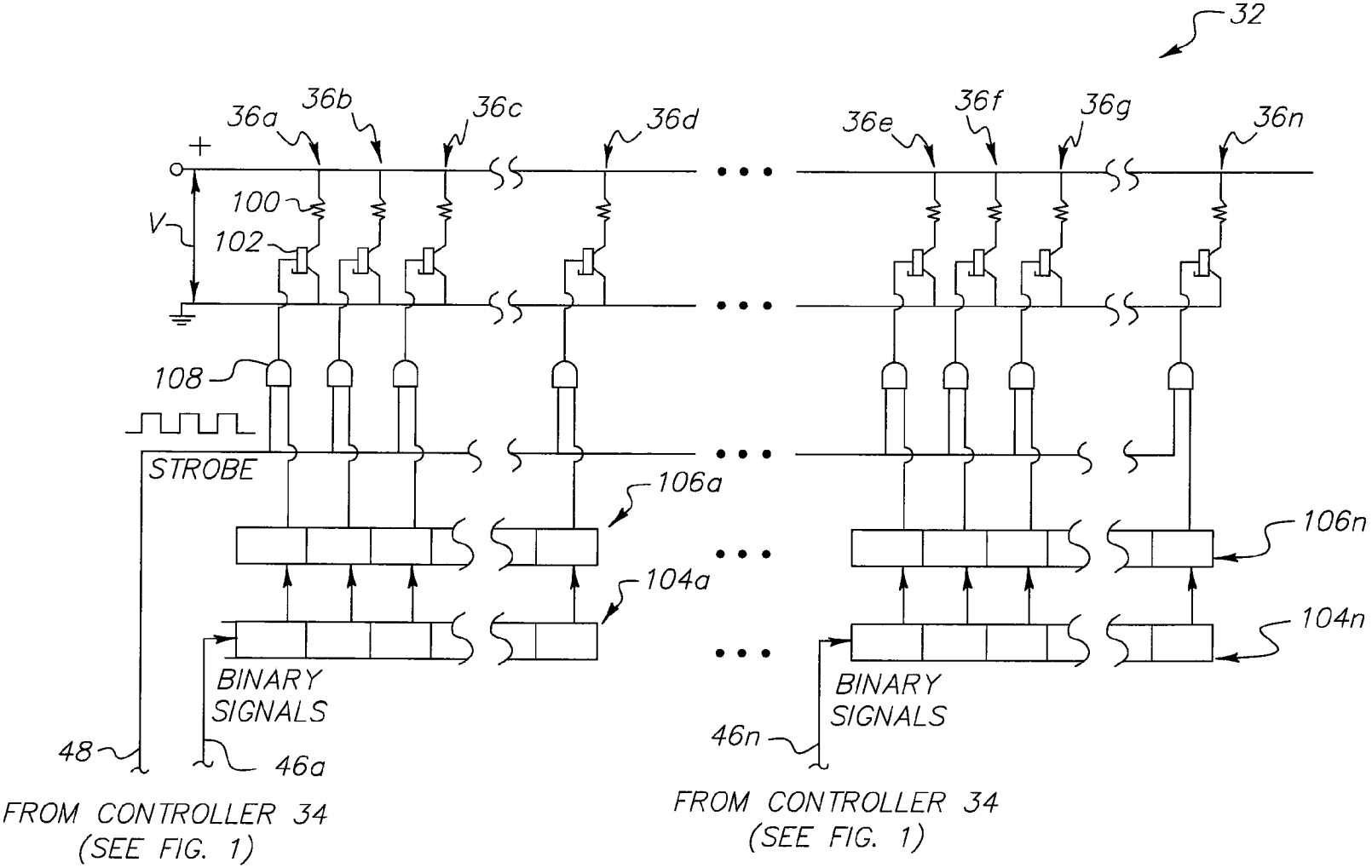
FIG. 3 is a block and schematic diagram illustrating an example implementation of a thermal printhead suitable for use with the present invention.

FIG. 3 is block and schematic diagram illustrating an example implementation of thermal printhead 32. Individually energizeable thermal elements 36 are illustrated as 36*a* to 36*n*, with each thermal element 36 comprising a resistor 100 and an electronic driver (e.g. a transistor) 102. In one embodiment, thermal printhead 36 comprises 4,480 individually energizeable thermal elements 36. In one embodiment, as illustrated, this number of thermal elements is subdivided into 35 groups of 128 individually energizeable thermal elements 36.

Thermal printhead 32 includes thirty-four serial-in, parallel-out, 128-element shift registers, illustrated as 104*a* to 104*n*, and thirty-four parallel-in, parallel-out, 128-element latch registers, illustrated as 106*a* to 106*n*. Each element of shift registers 104 is coupled to a corresponding element of a corresponding shift register 106, with each element of shift registers 104 and 106 corresponding to a different one of the thermal elements 36. A gating means (e.g. an AND-gate) 108 is positioned between each thermal element 36 and the corresponding element of latch register 106. A first input of gating means 108 is coupled to the corresponding element of latch register 106, and a second input receives a strobe signal from controller 34 (see FIG. 1). The output of gating means 108 is coupled to and controls electronic driver 102.

In operation, controller 34 (see FIG. 1) serially provides to each thermal element 36 a binary signal 46 representative of a density. Controller 34 sequences the binary signals and provides to shift register 104 a serial stream of the 1-bit values comprising the binary signals for each thermal element 36 corresponding to shift register 104, as indicated at 46. Upon serial shifting one line of data into shift register 104, the 1-bit values are parallel-shifted to latch register 106. In one example, as illustrated, enable signal 48 comprises a strobe signal. Strobe signal 48 and the 1-bit values from latch registers 106 control electronic drivers 104 to create electrical pulses through resistors 100 and produce thermal energy required to provide density changes in thermosensitive media 38 (see FIG. 1).

In one example, each binary signal for each thermal element comprises 511 one-bit values. As such, the above process would need to be repeated 511 times to produce one line of pixels of the printed image. In such an instance, the binary signals provided by controller 34 to thermal elements 36 of groups 60*a*, 60*b* to produce the desired border energy level each comprise a series of 511 one-bit data values.

Figure 4:
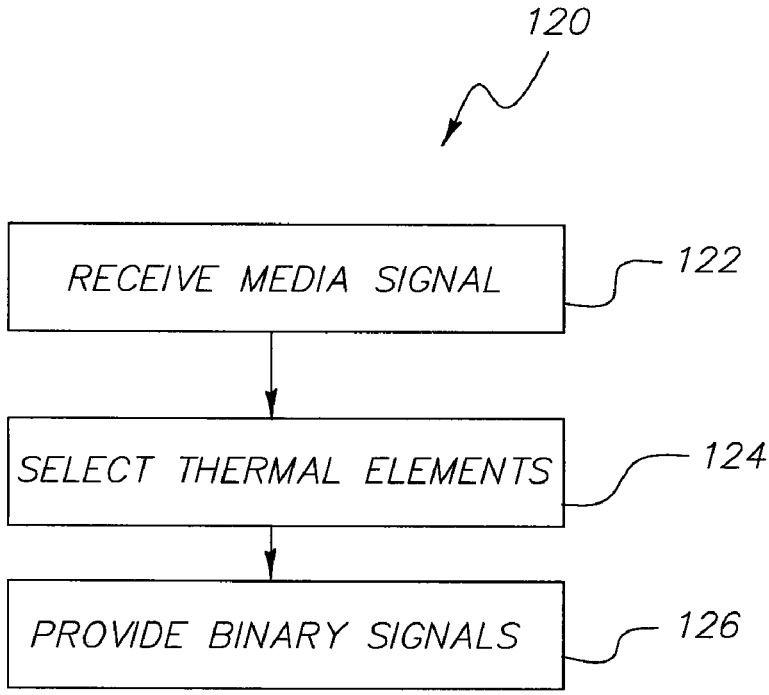
FIG. 4 is a flow diagram illustrating generally an example process in accordance with the present invention for printing borders of a thermosensitive media.

FIG. 4 is a flow diagram illustrating generally an example process 120 in accordance with the present invention for printing borders of thermosensitive media to reduce wear on a thermal printhead. Process 120 begins at 122 with receipt of a media signal indicative of dimensions of a sheet of thermosensitive media to be printed such as, for example, the width of the media. At 124, based on the dimensions of the thermosensitive media from the media signal, a group of thermal elements of the thermal printhead which correspond to one or more border areas of the thermosensitive media are selected.

At 126, binary signals are provided to each of the thermal elements selected at 124 that cause the selected thermal elements to provide an amount of thermal energy substantially equal to a desired border energy level. In one embodiment, providing the binary signals includes providing predetermined binary signals stored in a memory. In one embodiment, providing the binary signals includes generating the binary signals based on factors such as, for example, the width of the thermosensitive media, a width of the border areas to be printed, and a temperature of the thermal printhead.

The invention has been described in detail with particular reference to certain preferred embodiments thereof, but it will be understood that variations and modifications can be effected within the spirit and scope of the invention.

PARTS LIST

30 Thermal Printer
32 Thermal Printhead
34 Controller
35 Memory
36 Thermal Element
38 Thermosensitive Media
40 Directional Arrow
42 Media Signal
44 Image Data
46 Binary Signals
48 Enable Signal
50 Image Area Thermal Elements
52 Image Area of Media
60*a*, 60*b* Border Area Thermal Elements
62*a*, 62*b* Media Border Areas
63*a*, 63*b* Printed Media Borders
70 Density Graph
72 X-axis—Thermal Energy
74 Y-axis—Media Density
76 Density Value—$D_{BASE}$
78 Density Value—$D_{MIN}$
80 Thermal Energy Value—$E_{MIN}$
82 Density Value—$D_{MAX}$
84 Thermal Energy Value—$E_{MAX}$
86 Density Value—$D_{FILM}$
100 Resistor
102 Electronic Driver
104 Shift Register
106 Latch Register
108 Gating Means
120 Edge Printing Process
122 Process Procedure
124 Process Procedure
126 Process Procedure

What is claimed is:

1. An imaging device for thermally recording images on a media having an image area, the imaging device comprising:

a plurality of individually controllable thermal elements, each thermal element configured to produce a level of thermal energy based on a binary signal so as to produce at a corresponding location on the media a density level that is a function of the level of thermal energy; and a controller configured to receive a media signal representative of a dimension of the media and, based on the media signal, configured to select from the plurality of thermal elements a group of thermal elements corresponding to locations outside the image area, and to provide to each thermal element of the selected group a binary signal that causes each thermal element of the selected group to provide a level of thermal energy substantially equal to a desired border energy level.

2. The imaging device of claim 1, wherein the controller drives the selected plurality of thermal recording elements with image signals comprising non-image data representative of a desired border density value.

3. The imaging device of claim 2, wherein the input signal is representative of characteristics of the imaging media.

4. The imaging device of the claim 3, wherein the input signal is representative of a width of the imaging media.

5. The imaging apparatus of claim 2 wherein the selected plurality of thermal recording elements correspond to border areas which are immediately adjacent to opposite edges of the imaging media.

6. The imaging device of claim 2, wherein the controller drives each thermal recording element of the selected plurality of thermal recording elements so as to provide an amount of thermal energy substantially equal to a desired border energy level.

7. The imaging device of claim 2, wherein the controller drives thermal recording elements of the array corresponding to the imaging area of the imaging media with image signals comprising image data representative of density values of a desired image.

8. The imaging device of claim 1, wherein the media includes a border area, and wherein the selected group of thermal elements corresponds to the border area.

9. The imaging device of claim 1, wherein the selected group of thermal elements comprises up to all thermal elements corresponding to areas outside the image area.

10. The imaging device of claim 8, wherein the desired border energy level is within a border energy level range.

11. The imaging device of claim 10, wherein the media softens when a threshold level of thermal energy is transferred to the media, and wherein a lower level of the border energy level range is at least equal to the threshold level.

12. The imaging device of claim 10, wherein thermal elements corresponding to locations beyond the border area of the media are thermally damaged when providing a level of thermal energy above a critical level, and wherein an upper level of the border energy level range is less than the critical level.

13. The imaging device of claim 10, wherein density values recorded on the media do not exceed a desired maximum density value, and wherein a lower level of the border energy level range is substantially equal to twenty percent of a thermal energy level required to produce the desired maximum density value on the media.

14. The imaging device of claim 10, wherein density values recorded on the media do not exceed a desired maximum density value, and wherein an upper level of the border energy level range is substantially equal to seventy percent of a thermal energy level required to produce the desired maximum density value on the media.

15. The imaging device of claim 1, wherein the binary signals provided to the selected group of thermal elements comprise a predetermined sequence of data values stored in a memory.

16. The imaging device of claim 1, wherein the binary signals provided to the selected group of thermal elements comprise a sequence of data values, and wherein the controller generates the binary signals based on the media signal.

17. The imaging device of claim 1, wherein the controller, based on the media signal, selects the group of thermal elements from a look-up table stored in a memory.

18. A direct thermal printer for thermally recording density values on a thermosensitive media, the thermal printer comprising:

a transport system configured to receive and transport the thermosensitive media through the thermal printer, the thermosensitive media having a desired imaging area and a width;

a printhead including a plurality of individually controllable thermal elements positioned to extend at least across the width of the thermosensitive media as the thermosensitive media moves through the printer; wherein each thermal element, in response to a binary representative of a density value, is configured to provide and transfer a level of thermal energy to a corresponding location on the thermosensitive media that produces the density value at the corresponding location; and a controller configured to receive a media signal representative of the width of the thermosensitive media and, based on the media signal, configured to select from the plurality of thermal elements a group of thermal elements corresponding to locations outside the desired image area and to provide to each thermal element of the selected group a binary signal that causes each thermal element of the selected group to provide a level of thermal energy substantially equal to a desired border energy level.

19. The thermal printer of claim 18, wherein the thermosensitive media has a desired border area, and wherein the thermal elements of the selected group of thermal elements correspond to the desired border area.

20. The thermal printer of claim 18, wherein the thermal elements of the selected group of thermal elements comprises up to all thermal elements corresponding to locations outside the desired image area.

21. The thermal printer of claim 18, wherein the thermosensitive media softens when a threshold level of thermal energy is transferred to the thermosensitive media, wherein thermal elements positioned at locations beyond the width of the thermosensitive media are thermally damaged when providing a level of thermal energy above a critical energy level, and wherein the desired border energy level is at least equal to the threshold level and less than the critical energy level.

22. An imaging device for thermally recording images on a media having an image area, the imaging device comprising:

a plurality of individually controllable thermal elements, each thermal element configured to produce a level of thermal energy based on a binary signal so as to produce at a corresponding location on the media a density level that is a function of the level of thermal energy;

means for receiving a media signal representative of characteristics of the media;

means for selecting from the plurality of thermal elements a group of thermal elements corresponding to locations outside the image area based on the media signal;

means for providing to each thermal element of the selected group a binary signal that causes each thermal element of the selected group to provide a level of thermal energy substantially equal to a desired border energy level.

* * * * *